US006132175A

United States Patent [19]

Cai et al.

[11] Patent Number: 6,132,175

[45] Date of Patent: Oct. 17, 2000

[54] COMPLIANT SLEEVE FOR CERAMIC TURBINE BLADES

[75] Inventors: Hongda Cai, Chandler, Ariz.; Dave Narasimhan, Flemington, N.J.; Thomas E. Strangman, Phoenix, Ariz.; Michael L. Easley, Tempe, Ariz.; Bjoern Schenk, Phoenix, Ariz.

[73] Assignee: AlliedSignal, Inc., Morris Township, N.J.

[21] Appl. No.: 09/083,394

[22] Filed: May 22, 1998

Related U.S. Application Data

[60] Provisional application No. 60/050,926, May 29, 1997.

[51] Int. Cl.[7] ..... F01D 5/28

[52] U.S. Cl. ..... 416/220 R; 416/221; 416/241 B; 416/248; 403/404; 403/29; 428/669; 428/672

[58] Field of Search ..... 416/219 R, 220 R, 416/221, 241 B, 248, 500; 403/29, 404; 428/627, 669, 670, 672, 680

[56] References Cited

U.S. PATENT DOCUMENTS

| | | | |
|---|---|---|---|
| 3,809,495 | 5/1974 | Stahl | 416/135 |
| 4,051,585 | 10/1977 | Walker et al. | 29/156.8 R |
| 4,102,602 | 7/1978 | Rottenkolber . | |
| 4,207,029 | 6/1980 | Ivanko | 416/241 B |
| 4,325,647 | 4/1982 | Maier et al. | 403/29 |
| 4,417,854 | 11/1983 | Cain et al. . | |
| 4,610,934 | 9/1986 | Boecker et al. | 428/627 |
| 4,820,126 | 4/1989 | Gavilan . | |
| 4,904,542 | 2/1990 | Mroczkowski | 428/610 |
| 5,001,019 | 3/1991 | Ito et al. | 428/621 |
| 5,160,243 | 11/1992 | Herzner et al. . | |
| 5,985,467 | 11/1999 | Beele | 428/623 |

*Primary Examiner*—Edward K. Look
*Assistant Examiner*—Matthew T. Shanley
*Attorney, Agent, or Firm*—Robert Desmond, Esq.

[57] ABSTRACT

A compliant sleeve for attaching a ceramic member to a metal member is comprised of a superalloy substrate having a metal contacting side and a ceramic contacting side. The ceramic contacting side is plated with a layer of nickel followed by a layer of platinum. The substrate is then oxidized to form nickel oxide scale on the ceramic contacting side and a cobalt oxide scale on the metal contacting side. A lubricious coating of boron nitride is then applied over the metal contacting side, and a shear-stress limiting gold coating is applied over the ceramic contacting side.

20 Claims, 2 Drawing Sheets

COMPLIANT SLEEVE FOR CERAMIC TURBINE BLADES

REFERENCE TO COPENDING APPLICATION

This application claims the benefit of U.S. Provisional Application No. 60/050,926 filed May 29, 1997.

GOVERNMENT RIGHTS

The Government of the United States of America has rights in this invention pursuant to Contract No. DEN3-335 awarded by the United States Department of Energy.

TECHNICAL FIELD

This invention relates generally to ceramic-to-metal turbine disk assemblies, and in particular to a compliant sleeve used to mount a ceramic blade to a metal turbine disk.

BACKGROUND OF THE INVENTION

It has long been recognized that the efficiency and performance of gas turbine engines could be improved by increasing the temperature of the gas exiting the combustor and flowing through the turbine. Historically, this temperature has been limited by the materials, usually high temperature steel or nickel alloys, used to form the first turbine stage vanes and blades. To permit higher gas temperatures it has been proposed to form the vanes and blades from a high strength silicon nitride, silicon carbide, or other ceramic which can withstand higher temperature than conventional nickel-base superalloys. As used herein the term "vane " refers to nonrotating airfoils and the term "blade" refers to rotating airfoils.

A major challenge in the application of advanced ceramics (e.g., silicon nitride) for structural applications, such as turbine blades, is the development of ceramic-superalloy attachments that avoid contact stress damage (i.e., creation of more severe population of surface flaws) on the ceramic attachment surface. Laboratory and engine tests have demonstrated that sliding contact damage to the ceramic bearing surface can be severe, which reduces ceramic strength below design requirements and can result in component failure. Analyses and experiments have shown that high-friction sliding on the ceramic bearing surface has the greatest potential for damaging the ceramic surface at operational loads. For example, cyclic sliding contact between a machined ceramic surface and a superalloy metal surface can generate contact damage on the ceramic surface at low pinch loads (stresses). In an operating engine, sliding between the ceramic dovetail and the superalloy disk occurs due to cyclic centrifugal stresses (due to starting and stopping the engine) and cyclic thermal expansion mismatch between the metallic disk slot and the silicon nitride ceramic blade's dovetail. Stresses are further increased when contact on the attachment surfaces is non-uniform due the effects of blade and disk machining tolerances.

One attempt to solve this contact damage problem uses a single compliant element inserted between the ceramic and the metallic components. Even the early authors recognized the difficulty of satisfactorily meeting the technical property requirements of a compliant layer, namely, the desire to yield and comply with surface irregularities of the ceramic and the need to have adequate strength to withstand the operating stresses at high temperature without compliant layer extrusion (see e.g. "Program Plan for the Design and Spin Test of Ceramic Blade-Metal Disk Attachments" by G. S. Calvert, ASME, 76-GT-37, March 1976 P 2-8, "Progress on Ceramic Rotor Blade Development for Industrial Gas Turbines" by Anderson et al, ASME 77-GT-42, December 1977, p 1–8). Cain et al., U.S. Pat. No. 4,417,854, teaches a compliant layer which is permanently attached to the ceramic component so that the contact damage is prevented. However, permanent attachment of metallic elements to a silicon nitride ceramic element required the use of reactive elements such as titanium or zirconium to facilitate wetting of the metallic component; reaction between silicon nitride and these elements occurs, resulting in damage to the surface of the ceramic element and a substantial loss of mechanical strength.

Others have successfully demonstrated ceramic blades inserted into a metallic disk of a turbine engine, but they employed only a single layer of a nickel alloy as a compliant layer between the ceramic and the metallic disk. (see "Development of 300 kW class ceramic gas turbine (CGT301) engine system" by Tatsuzawa et al, ASME 95-GT-201, June 1995, p 1–7). However, this engine is not intended for multiple start- stop cycles. The attachment was successful, but did not have to accommodate cyclic centrifugal and thermal expansion mismatch stresses and cyclic sliding.

Accordingly, there is a need for a multielement compliant sleeve for mounting a ceramic airfoil to a metal disk that can comply with surface irregularities of the ceramic and still have the strength to withstand the operating stresses at high temperature without experiencing layer extrusion.

SUMMARY OF THE INVENTION

An object of the present invention is to provide a multielement compliant sleeve for mounting a ceramic airfoil to a metal disk that can comply with surface irregularities of the ceramic and still have the strength to withstand the operating stresses at high temperature without experiencing layer extrusion.

The present invention achieves this object by providing a multielement compliant sleeve for attaching a ceramic member to a metal member. The sleeve is comprised of a superalloy substrate (e.g., the cobalt-base HS25 superalloy) having a metal contacting side and a ceramic contacting side. The ceramic contacting side is plated with a layer of nickel followed by a layer of platinum. The plated substrate is then oxidized to form nickel oxide scale on the ceramic contacting side and a cobalt oxide scale on the metal contacting side. A lubricious coating of boron nitride is then applied over the oxide on the metal contacting side, and a shear-stress limiting gold coating is applied over the oxide on the ceramic contacting side.

DESCRIPTION OF THE PREFERRED EMBODIMENT

Figure 1:
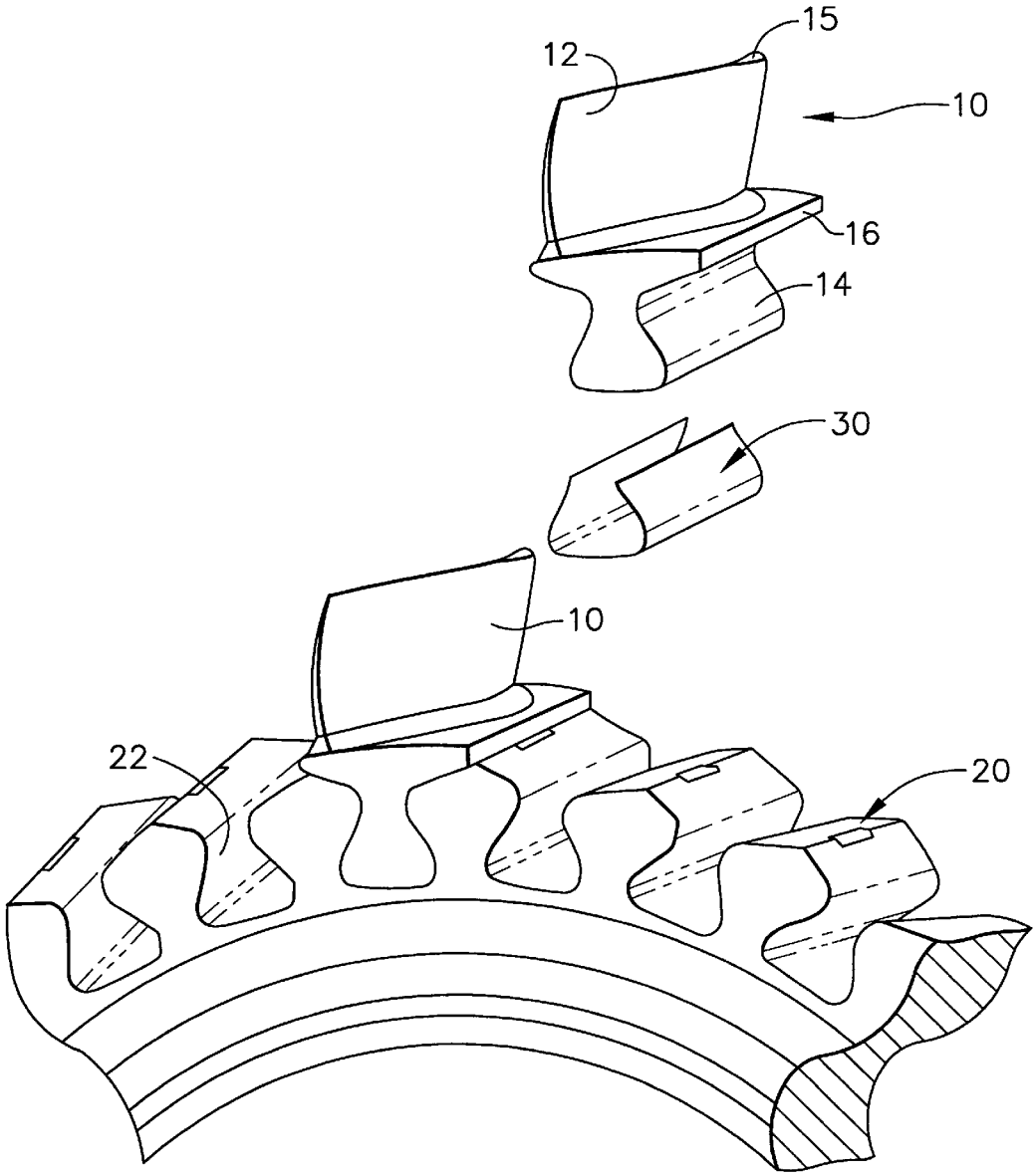
FIG. 1 is an exploded, perspective view of a ceramic-tometal turbine disk assembly contemplated by the present invention.
Figure 2:
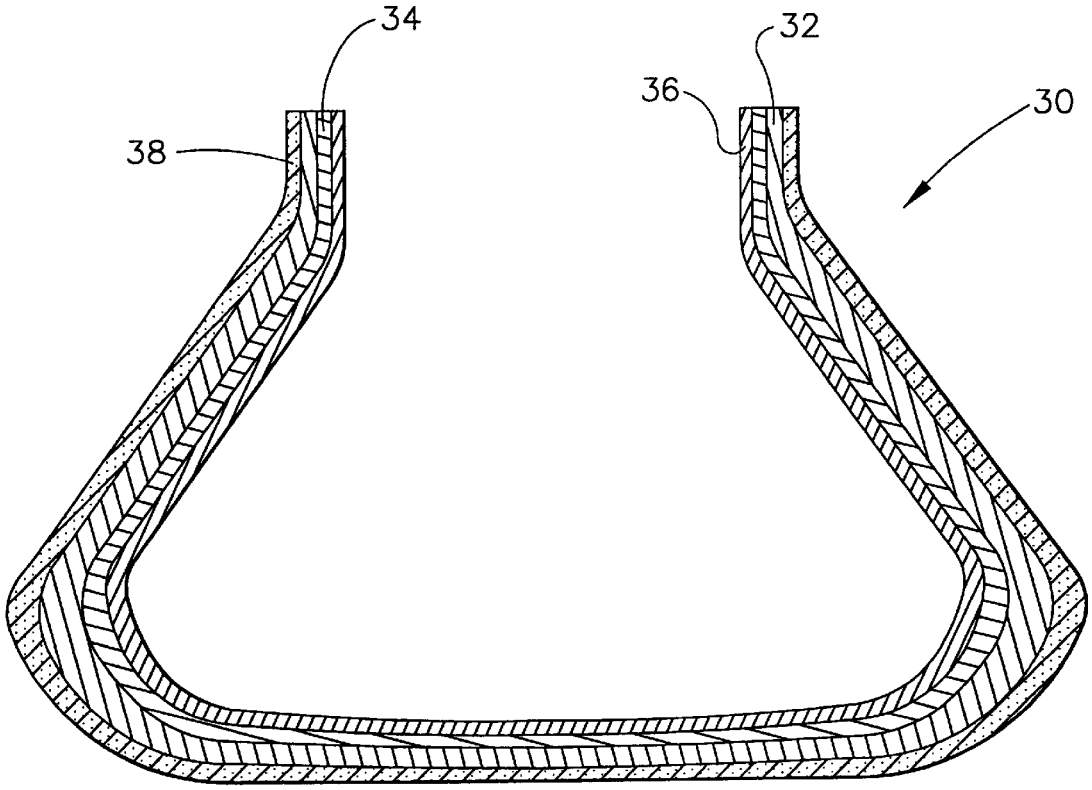
FIG. 2 is a cross section of the compliant sleeve contemplated by the present invention.

FIG. 1 shows a blade 10 having an airfoil portion 12, an attachment or root portion 14, and usually a platform or stabilizer 16 between the two sections. The blade 10 is integrally formed from ceramic such as a silicon nitride, preferably a sintered silicon nitride with about 10 wt. percent additives of rare earth oxides. In some applications the blade 10 can be formed with an outer shroud, (not shown) along the blades tip 15. In the preferred embodiment, the root portion 14 has a dovetail shape. Still referring to FIG. 1, a turbine disk 20 has a plurality of slots 22 having dovetail shape for receiving the root portion 14. The disk 20 is formed from a steel or nickel alloy. A metal bent tab or cover plate, not shown, may be used to hold the blade and its protective compliant sleeve 30 in the disk slot.

A composite compliant layer or sleeve 30 also has a dovetail shape to match that of the root portion 14 and the slots 22. The sleeve 30 is comprised of a substrate 32 having a thickness of 75 to 250 microns with 125 microns preferred and is preferably made of a solid solution strengthened cobalt or nickel based super alloy such as Haynes alloy HS25 or Inco X-750. Covering the inner surface of the substrate 32, which contacts the ceramic surface of the root portion 14, is a soft layer 34 formed of a material having a lower yield strength than the substrate. This soft layer 34 has a thickness of about 25 to 75 microns, with 50 microns preferred. Its relatively lower yield strength permits it to deform and conform (fill) the asperites such as machining grooves on the mating ceramic surface. It should be stable and inert in the intended application conditions so that its properties do not change appreciably during the lifetime of the layer. This soft layer 34 is preferably made of relatively soft low strength materials such as nickel, cobalt, platinum, platinum and rhodium, other platinum alloys, as well as soft oxides, such as nickel oxide, cobalt oxide and combinations thereof. These materials are capable of accommodating dimensional tolerance variations up to 25 microns and extruding into microscopic surface asperites. Accommodation of these irregular surface features maximizes the contact area and minimizes contact stress. Also, since the soft layer 34 physically conforms to the features of the ceramic surface, it can inhibit gross relative sliding therebetween. The soft layer 34 can be applied to the substrate 32 either by electroplating, sputtering, physical vapor deposition, or chemical vapor deposition or other methods. This is followed by vacuum heat treatment (1 hour at about 1000 degrees C.) to diffusion bond the layer 34 to the substrate 32. During this heat treat alloying elements in the substrate (e.g. Ni, Co, Cr, W) diffuse into the soft layer increasing its yield strength near its interface with the substrate. The concentration of these elements in the soft inner layer declines as a function of distance from the interface.

An engine typically reaches its operational speed (maximum centrifugal stress condition) well before the sleeve 30 warms to its steady-state temperature. Consequently, the sleeve is pinched between the blade 10 and disk 20 while it is still relatively cool. If the superalloy substrate were unconstrained, it would expand significantly more than the ceramic (e.g., about 0.006 in./in., depending on the mismatch of the thermal expansion coefficients and temperature range) when steady state disk rim temperature is achieved. If the friction between the soft layer 34 and the ceramic surface of the root portion 14 is high, the pinch load prevents the expansion of the substrate. If the creep strength of the substrate at the operating temperature is high, this constraint can be accommodated elastically. On the other hand, when the creep strength of the substrate is lower or the constraint imposed generates a stress larger than that can be accommodated elastically, the substrate partially relaxes the compressive stress and deforms plastically. Since the sleeve's growth is constrained in the dovetail's axial direction, partial stress relaxation shortens the sleeve by a small amount (approximately ≦0.001 inch reduction per inch of length per engine cycle.) When the engine is shut down, normal stresses (on the interface) and thus frictional stresses are relaxed and the ceramic blade releases the sleeve. Stress-relaxation and associated shrinkage is cumulative; i.e., the sleeve can shrink each engine cycle. Since this shrinkage is restricted to the contact surface between the ceramic and the sleeve, the remaining portions of the compliant sleeve structure deforms elastically and plastically to accommodate this dimensional change, eventually resulting in severely warped and cracked compliant sleeve elements.

Therefore, where an engine is expected to operate with frequent cycling, a shear stress limiting lubricant 36 is required between the ceramic of the blade 10 and the soft layer 34. The shear stress limiting lubricant 36 reduces the constraint on the superalloy substrate; that is, it permits the substrate to partially expand which minimizes the amount of stress-relaxation and shrinkage that occurs in the superalloy substrate per engine cycle. The lubricant is preferably a soft metal selected from a group comprising gold, silver, and molten glasses such as borosilicate glasses, and mixtures of hexagonal boron nitride and boron oxides, with gold being preferred. The thickness of the lubricant preferably about 1 to 5 microns, but is not limited to that value.

To assure that most of the gross sliding occurs at the interface between the disk and the compliant sleeve the outer surface of the substrate 32 may be oxidized by exposing it to a temperature of about 1000 degrees C. for a half hour in air to produce a lubricious oxide such as cobalt oxide. In addition, a lubricant layer 38 of hexagonal boron nitride and mixtures of these with glasses including those with boric oxide, may be applied to the outer surface of the substrate 32.

EXAMPLE

A compliant sleeve comprising a 0.005 in. (127 microns) thick substrate of HS25 had plated on its inside a 0.0014 in. (36 microns) thick layer of nickel and then 0.0006 in. (15 microns) thick layer of platinum. The coated substrate was then heat treated in vacuum for 1 hour at 1000° C., which improved bonding of the coating to the HS25 substrate. The compliant layer was then oxidized in air for 0.5 hour at 1000 C., resulting in a predominately cobalt oxide scale on the outside surface of the substrate and a nickel oxide on the ceramic contact surface. A boron nitride lubricious coating was applied over the cobalt oxide scale. The sleeve was evaluated in a subelement test rig. The test rig simulates the attachment geometry. It consists of two dovetail grippers which hold two pieces of wear elements that simulate the blade disk slots. A double ended ceramic specimen, each end simulates the ceramic blade root is fit into the wear element slots, is pulled in cyclic tension. Under a typical cycle time of 30 sec and a peak load equivalent to 114% of the blade's attachment load in an AlliedSignal 331-200 CT engine, the average number of cycles to fracture the ceramic attachment was found to be 5900 cycles for dovetail attachments fitted with the sleeve. The average accumulated time was about 50 hr. Additional tests of longer cycles on the order of 0.5 to 1 hr/cycle were conducted to evaluate sleeve's durability. The sleeves were tested to an accumulated time of 200 hr or longer (without failure), which is four times the average accumulated time for the tests of short cycle time. The results indicated that the sleeve's life was more cycle-dependent than time-dependent.

The sleeve was applied to ceramic blades and evaluated in an engine environment (test bed AlliedSignal Engine 331-200 CT) in four tests. In the first engine test, the sleeve was has described in the previous example with the addition of a layer of BN over the nickel oxide on the sleeve's interface with the ceramic dovetail. The engine test of 100 hours and 100 cycles was completed successfully, with no blade failures. The sleeves were found to be in excellent conditions; that is there was no detectable substrate thinning, no visible fretting damage on the contact surface between the ceramic blade root and sleeve, and between the sleeve and metal disk blade root. The BN oxidized in the engine environment to generate $B_2O_3$ which acted as an excellent lubricant between the metallic disk and the sleeve. The oxidized BN layer limited the shear between the soft layer and the ceramic so that the sleeve stresses were accommodated in the elastic range resulting in distortion-free sleeves. The only adverse finding from this test was that the oxidized boron nitride reacted slightly with the silica rich surface of the silicon nitride blade and the NiO surface of the sleeve resulting in non-critical (e.g., micron-depth roughening) damage to the contact surfaces of the silicon nitride blades.

In a second 100 hour, 100 cycle engine test, the configuration of the sleeve was as in the first engine test except that there was no BN layer between the nickel oxide surface of the sleeve and the silicon nitride blade dovetail. This test was successful in that there were no ceramic blade failures and no non-critical damage to the blades' attachment surface. On the other hand, the sleeves experienced axial shrinkage on contact surfaces and cracking in non-contact areas. A comparison of results from engine tests 1 and 2, validates the benefit of a shear limiting layer between the soft compliant layer and the ceramic dovetail.

In the third 100 hour/100 cycle engine test, a thin layer of silver replaced BN between the nickel oxide and the ceramic. This test was successful in that there were no ceramic blade failures and no non-critical damage to the blades' attachment surface. Distortion and cracking of the sleeve were intermediate between the results of from engine tests 1 and 2.

In the fourth 205 hour/50 cycle engine test, sputtered gold was disposed between the nickel oxide and the ceramic blade. This test was again successful in that there were no ceramic blade failures. The thin layer of gold resulted in minimal distortion (estimated at $\leqq 0.002$ inch over the axial length of 1 inch) and no cracking of the sleeve.

In all these engine tests, the ceramics were supported under high load and were subjected to varying cyclic temperature in the dovetail attachment. Without the compliant sleeve, these ceramic elements would have readily fractured within a few cycles.

Various modifications and alterations of the above described invention will be apparent to those skilled in the art. In particular, the present invention is applicable to any attachment situation requiring load transfer and/or varying temperatures. Besides ceramic blade attachment, other foreseeable application of the present inventions are ceramic vane attachments, seal element attachments and ceramic blisk attachments. Accordingly, the foregoing detailed description of the preferred embodiment of the invention should be considered exemplary in nature and not as limiting to the scope and spirit of the invention.

What is claimed is:

1. A composite sleeve for mounting a ceramic member to a metal member comprising:

a substrate have a metal contacting side and a ceramic contacting side, said metal contacting side configured to slideably engage said metal member and said ceramic contacting side configured to slideably engage said ceramic member;

a soft layer over said ceramic contacting side and formed of a material having a lower yield strength than said substrate; and a first lubricant over said metal contacting side.

2. The compliant sleeve of claim 1 further comprising a second lubricant over said soft layer.

3. The sleeve of claim 1 wherein said material for said soft layer is selected from a group consisting of nickel, cobalt, platinum, platinum and rhodium, nickel oxide, cobalt oxide and combinations thereof.

4. The sleeve of claim 3 wherein said soft layer comprises at least one layer selected from a group consisting of nickel, cobalt, platinum, and platinum and rhodium, and an oxide layer over said one layer.

5. A compliant sleeve for attaching a ceramic member to a metal member comprising:

a substrate having a metal contacting side and a ceramic contacting side;

a soft layer over said ceramic contacting side and formed of a material having a lower yield strength than said substrate;

a first lubricant over said metal contacting side; and a second lubricant over said soft layer, said second lubricant selected from a group consisting of gold, silver, molten glasses, boron nitride and boron oxides.

6. The sleeve of claim 5 wherein said second lubricant is gold.

7. The sleeve of claim 5 wherein said second lubricant is silver.

8. The sleeve of claim 5 wherein said second lubricant is boron nitride.

9. The sleeve of claim 5 wherein said first lubricant is a lubricious oxide.

10. The sleeve of claim 9 wherein said lubricious oxide is cobalt oxide.

11. The sleeve of claim 9 wherein said first lubricant further comprises a layer of boron nitride over said lubricious oxide.

12. The sleeve of claim 9 wherein said first lubricant further comprises a layer of a mixture of boron nitride and glasses that contain boron oxide.

13. The sleeve of claim 12 wherein said glasses includes boric acid.

14. The sleeve of claim 1 wherein said substrate is a superalloy.

15. An assembly for a gas turbine engine comprising:

a plurality of ceramic airfoils each having an airfoil portion and a root portion;

a metal disk having a plurality of slots for receiving said root portions; and a plurality of compliant sleeves each sleeve disposed between one of said root portions and one of said slots and comprising a superalloy substrate having a metal contacting side configured to slideably engage said slot and a ceramic contacting side configured to slideably engage said root portion;

a soft layer over said ceramic contacting side and formed of a material having a lower yield strength than said substrate; and a first lubricant over said metal contacting side.

16. The assembly of claim 15 further comprising a second lubricant over said soft layer.

17. The assembly of claim 15 wherein said soft layer comprises at least one layer selected from a group consisting of nickel, cobalt, platinum, and platinum and rhodium, and an oxide layer over said one layer.

18. An assembly for a gas turbine engine comprising:

a plurality of ceramic airfoils each having an airfoil portion and a root portion;

a metal disk having a plurality of slots for receiving said root portions;

a plurality of compliant sleeves each sleeve disposed between said root portion and said slot and comprising a superalloy substrate having a metal contacting side and a ceramic contacting side;

a soft layer over said ceramic contacting side and formed of a material having a lower yield strength than said substrate;

a first lubricant over said metal contacting side; and a second lubricant over said soft layer, said second lubricant selected from a group consisting of gold, silver, molten glasses, boron nitride and boron oxides.

19. The assembly of claim 18 wherein said first lubricant is a lubricious oxide.

20. The assembly of claim 19 wherein said first lubricant further comprises a layer of boron nitride over said lubricious oxide.

* * * * *